US005659931A

United States Patent [19]

Anscher

[11] Patent Number: 5,659,931

[45] Date of Patent: *Aug. 26, 1997

[54] BUCKLE WHICH IS RELEASABLE BY DEPRESSION OF A HINGED MEMBER

[75] Inventor: Joseph Anscher, Muttontown, N.Y.

[73] Assignee: National Molding Corp., Farmingdale, N.Y.

[ * ] Notice: The term of this patent shall not extend beyond the expiration date of Pat. No. 5,542,161.

[21] Appl. No.: 670,050

[22] Filed: Jun. 25, 1996

Related U.S. Application Data

[63] Continuation of Ser. No. 241,382, May 11, 1994, Pat. No. 5,542,161.

[51] Int. Cl.[6] ..... A44B 11/25; A44B 17/00; A44B 1/04; A43C 11/00; A41F 1/00

[52] U.S. Cl. ..... 24/614; 24/573.1; 24/606

[58] Field of Search ..... 24/606, 607, 614, 24/615, 630–633, 573.1, 573.5

[56] References Cited

U.S. PATENT DOCUMENTS

| | | | |
|---|---|---|---|
| D. 289,622 | 5/1987 | Crowle et al. | D11/216 |
| D. 343,144 | 1/1994 | Matoba | D11/216 |
| 711,826 | 10/1902 | Collins | 24/616 |
| 1,606,991 | 11/1926 | Gammell | 24/614 |
| 4,559,679 | 12/1985 | Downey | 24/573.1 X |
| 4,679,282 | 7/1987 | Feng | 24/614 |
| 4,802,262 | 2/1989 | Kasai | 24/606 |
| 4,864,700 | 9/1989 | Kasai | 24/573 |
| 4,866,819 | 9/1989 | Kasai | 24/614 |
| 4,894,890 | 1/1990 | Kasai | 24/573 |
| 4,977,650 | 12/1990 | Ida | 24/614 |
| 5,380,238 | 1/1995 | Crew-Gee | 24/573.1 X |
| 5,542,161 | 8/1996 | Anscher | 24/573.1 X |

FOREIGN PATENT DOCUMENTS

| | | |
|---|---|---|
| 0 256 398 A1 | 2/1988 | European Pat. Off. . |
| 39 30 604 A1 | 3/1990 | Germany . |

*Primary Examiner*—James R. Brittan
*Attorney, Agent, or Firm*—Kenyon & Kenyon

[57] ABSTRACT

A multiple-piece buckle having a socket member and at least one plug member, wherein the plug member has a resilient tongue which defines an aperture or other opening near a distal end thereof, and wherein the socket member includes a lug or pin which is adapted to fit into the aperture to lock the plug member into the socket member. The socket member includes a hinged plate or button in a top face thereof which can be depressed to force the resilient tongue of the plug member away from the pin to release the aperture so as to disengage the buckle.

8 Claims, 6 Drawing Sheets

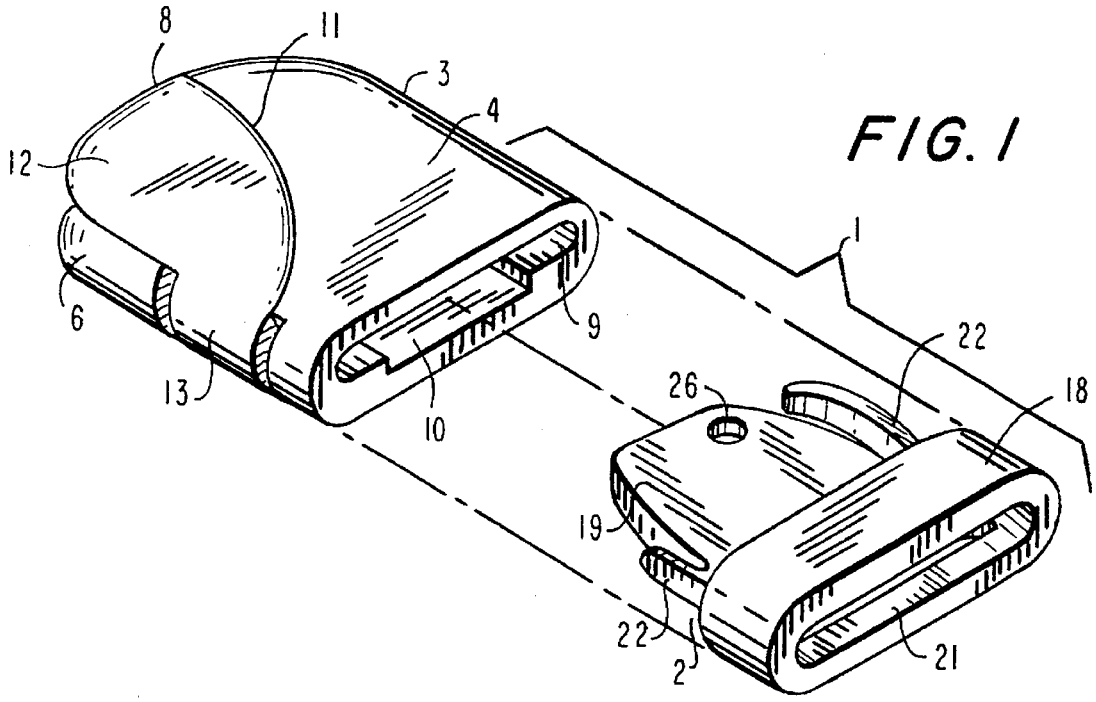
FIG. 1
FIG. 2
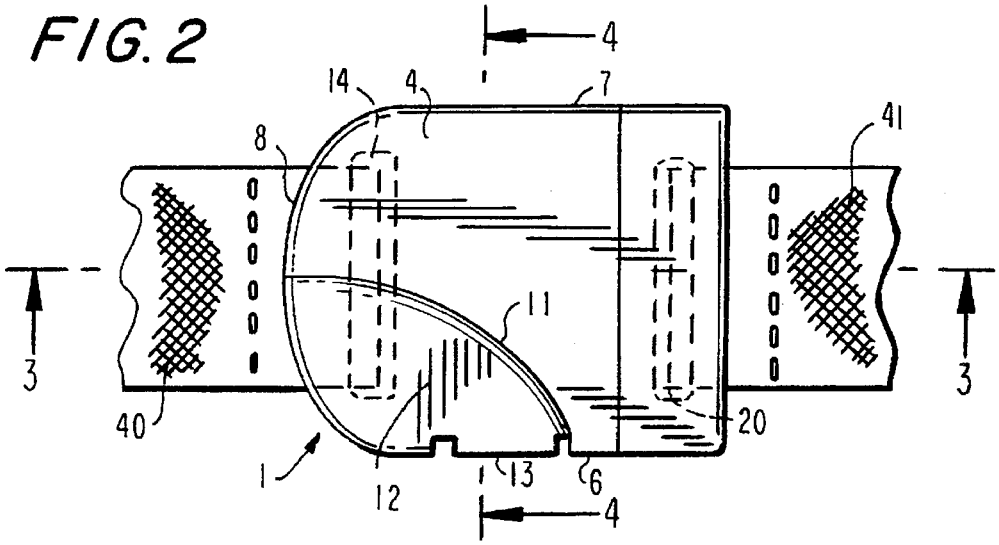

BUCKLE WHICH IS RELEASABLE BY DEPRESSION OF A HINGED MEMBER

This application is a continuation of U.S. application Ser. No. 08/241,382 filed May 11, 1994, now U.S. Pat. No. 5,542,161.

BACKGROUND OF THE INVENTION

1. Field of the Invention

The invention relates generally to multiple piece buckles having at least one male member and one female member which are disengaged by depressing a resilient flap or the like on one of the members.

2. Description of Related Art

Assorted two-piece buckles are known in the art. These buckles typically include a female or socket member which is engageable with a male or plug member. One or both of the members adjustably or fixedly hold a strap or belt around crossbars or the like. One particularly common form of two-piece buckle is one in which the plug member includes a pair of legs which, when inserted into the socket member, flex inwardly and slide past opposing stop members in the socket until they snap fit into respective side openings in the socket. The two buckle pieces are disengaged by squeezing the legs of the plug member through the openings in the socket between the thumb and forefinger, thereby freeing the legs from the respective stop members in the socket and allowing the two pieces of the buckle to become separated. Cooperating canted or arcuate surfaces on the legs and the interior of the socket member facilitate movement of the plug and socket away from each other when they are disengaged, and the flexed legs exert a spring like force to urge the plug member out.

Although these so-called "side release" buckles have found wide use in luggage, baggage, sporting equipment, etc., they have not found universal acceptance because in certain applications it is desirable to be able to release the buckle pieces in a different manner (i.e., without squeezing the buckle between opposite sides with two fingers). For example, in certain applications where someone wearing mittens may find it difficult to open a side release buckle, it is desirable to have a buckle which can be released with less dexterity. Accordingly, two-piece buckles have been developed which are releasable by depressing a button or the like on a top face of one of the buckle members. Examples of these types of buckles are described in U.S. Pat. Nos. 4,802,262; 4,864,700; 4,866,819; and 4,894,890 to Kasai. The plug member of these buckles includes a locking lug near the distal end thereof which, when inserted into the socket member, slides over a stopper crossbar in the socket. Once it is beyond the stopper bar, the locking lug snaps into place behind it thereby preventing the plug member from being removed. The two pieces of the buckle are disengaged by depressing a resilient flap located in the center region of a top or bottom face of the socket member. The flap is hinged along a line which is transverse to the direction of insertion of the plug into the socket. The inside surface of the flap has a releasing lug which acts on the locking lug of the plug member to push it away from the stopper bar, thereby freeing the plug member from the socket member. Thus, these types of buckles merely require one finger to push down on the flap or button to disengage the two pieces.

However, one drawback to this push button-type buckle is that when the button is pushed, the two pieces do not "spring out" from each other with the same ease as in a side release buckle where the two flexed legs on the plug member supply the force to result in such a spring action during disengagement. Rather, the buckles described by Kasai rely on beveled or canted surfaces on the stopper bar and locking lug to help urge the two buckle pieces apart during disengagement. However, this arrangement is not as effective as the spring action imparted by the resiliently flexible legs of the side release type buckles.

Accordingly, it would be desirable to combine the spring action of a side release buckle with the single push button releasing mechanism of a push button type buckle.

SUMMARY OF THE INVENTION

It is an object of the invention to provide a multiple piece buckle which is released by depressing a single flap or hinged member integral with a top face of the buckle.

It is a further object of the invention to provide such a buckle which exhibits a spring-like separation action upon disengagement so as to exhibit improved releasability as compared to single push button type buckles of prior art.

It is another object of the invention to provide a multiple piece buckle having at least one male member and one female member wherein the male member includes a tongue having an aperture or socket portion which is engageable with a lug or projection member in the female member, wherein the buckle is released by depressing a hinged member on a face of the female member to result in movement of the aperture clear of the lug.

It is yet another object of the invention to provide a push button-type buckle wherein the flap comprising the push button is hinged from one side of the female member of the buckle, rather than from a line which is transverse to the insertion direction of the plug, so as to allow room for insertion of a leg of the other buckle member in the vicinity of the other side of the female member.

These and other objects of the invention are achieved by a multiple-piece buckle having a socket member and at least one plug member, wherein the plug member has a resilient tongue which defines an aperture or other opening near a distal end thereof, and wherein the socket member includes a lug or pin which is adapted to fit into the aperture to lock the plug member into the socket member. The socket member includes a hinged plate or button in a top face thereof which can be depressed to force the resilient tongue of the plug member away from the pin to release the aperture so as to disengage the buckle. The plug member can include one or more resilient legs which cooperate with side surfaces inside the socket member whereby the legs flex inwardly upon insertion of the plug into the socket upon engaging these surfaces. Upon disengaging the buckle members, the legs facilitate release by urging the plug member to "spring out" of the socket. For this purpose, the pin or lug in the socket is preferably canted in a direction to cause the resilient tongue of the plug to slide down the surface in a direction away from the socket member. The surface of the resilient tongue which engages the locking pin or lug may be also be canted to facilitate releasability, whereby the canted surfaces of the locking pin and tongue allow for easy sliding of the tongue over the pin.

In another embodiment of the invention, the locking pin or lug on the female member may be replaced with a locking bar, and the aperture or opening on the tongue of the plug member may be defined, in part by a latch or bar which is engageable with the locking bar in the socket.

The inventive buckle may be a two-piece buckle having one plug and one socket, or a three-piece buckle having one socket with two opposing receiving ends and a pair of plug members.

In accordance with the invention, the flap or hinged member defining the button is hinged along a line on one side of the socket member which is parallel to the insertion direction of the tongue of the plug member. This allows for the button or hinged member to be positioned on one side of the buckle, rather than in the central area where it may be more difficult to depress. In addition, this arrangement allows for the three-piece embodiment of the buckle because the hinged member pivoting from one side of the socket member does not interfere with the insertion of two plug members from opposite ends into the socket. In contrast, the hinge line of the flap in buckles of the prior art extends from side to side (i.e., perpendicular or transverse to the direction of insertion of the plug) which does not permit the insertion of more than one plug member into opposite ends of the socket.

BRIEF DESCRIPTION OF THE DRAWINGS

FIG. 1 is a perspective view of a plug member and a socket member of a two-piece buckle in accordance with the invention.

FIG. 2 is a top planar view of the two-piece buckle of FIG. 1 wherein the plug and socket are coupled to each other.

DETAILED DESCRIPTION OF THE INVENTION

Figure 3:
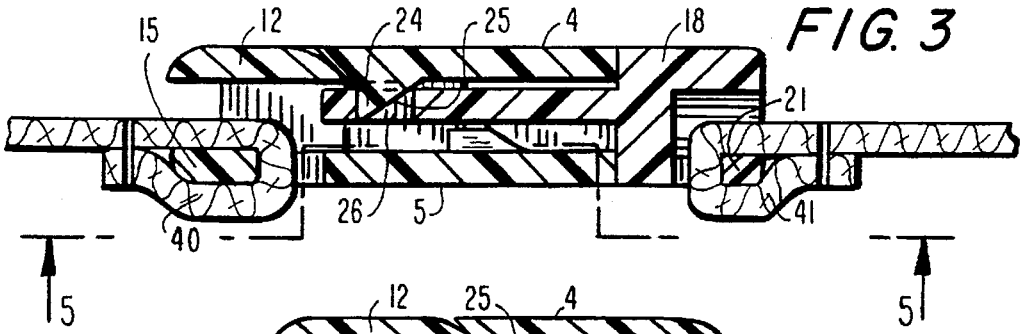
FIG. 3 is a cross-sectional view of the buckle of FIG. 2 taken along line 3—3.
Figure 4:
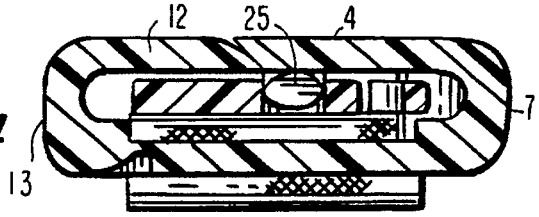
FIG. 4 is a cross-sectional view of the buckle of FIG. 2 taken along the line 4—4.
Figure 5:
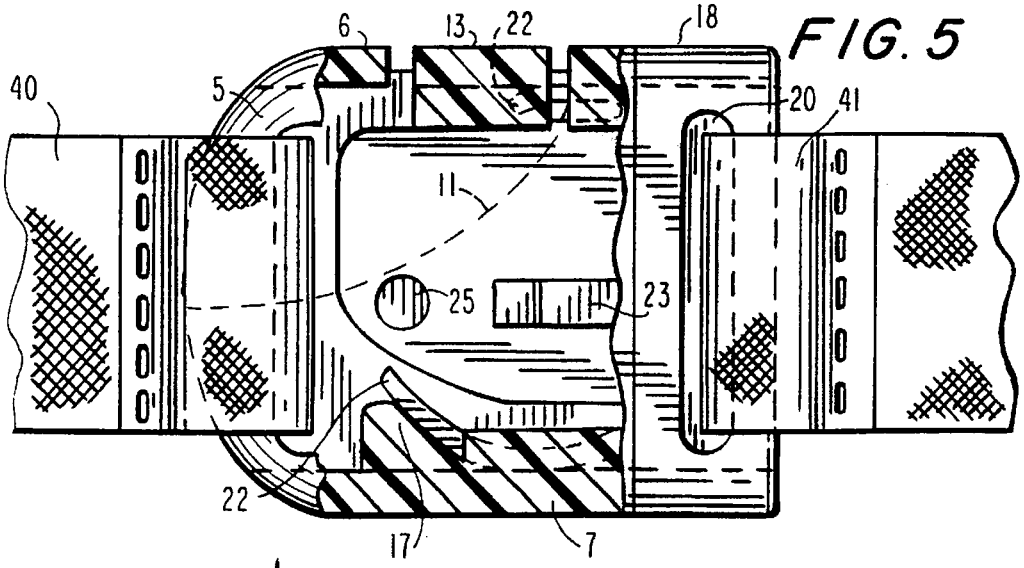
FIG. 5 is a cross-sectional view of the buckle of FIG. 3 taken along the line 5—5.

Referring to FIGS. 1–7, a two-piece buckle in accordance with the invention is generally illustrated at 1. The buckle 1 includes a plug member 2 and a socket member 3 (see FIG. 1). The socket 3 includes a substantially planar top face 4, a substantially planar bottom face 5, side walls 6, 7 and a proximal end 8. The socket 3 is a relatively thin, flat member whose top 4 and bottom 5 faces are much larger than its side walls 6, 7. Opposite the proximal end 8 is an insertion opening 9. The top 4 and bottom 5 faces enclose a compartment or guide chamber 10 therebetween for receiving the plug member 2. The insertion end 9 of the socket member 3 is open and allows for entrance of the plug member into the compartment or guide chamber 10. Guide chamber 10 may include a sloped side wall 17 whose function will be described hereinafter.

A portion of the top face 4 of the socket member 3 is cut along a line 11 so as to define a resilient button or flap 12. In this embodiment, the cutaway line 11 extends from a point along the proximal end 8 of the socket to another terminal point located somewhere along side 6 of the socket. The line 13 along which the flap 12 remains connected to the side wall 6 functions essentially as a hinge 13 about which the flap 12 can pivot. Because the hinge line 13 is disposed along a side of the socket, the hinge line 13 is parallel, not transverse, to the direction of insertion of the plug member into the socket (see FIG. 1). The socket 3 is open in the region between the flap 12 and the bottom face 5 to permit pushing movement of the flap toward the interior of the socket. As known in the art, the buckle may be molded from any resin which would allow for resilient flexibility of the flap 12 about hinge line 13, such as polypropylene.

The bottom face 5 of the socket member 3 has a transverse slot 14 (illustrated in phantom in FIG. 2) therein, extending between sides 6 and 7. Slot 14 defines a crossbar 15 (see FIGS. 3 and 6). The end of a strap or belt 40 may be threaded through the slot 14 and wrapped around crossbar 15.

The plug member 2 includes a proximal base portion 18 from which a resilient tongue 19 extends distally. The tongue 19 is of a greatly reduced thickness relative to the base 18 so that it may be inserted into the guide chamber 10 of the socket 3 through insertion opening 9. However, the proximal base 18 of the plug 2 has approximately the same width from side to side and thickness from top to bottom as the socket member so that when the plug is coupled to the socket, the top and bottom faces and the sides thereof are contiguous and smooth giving the two-piece buckle a smooth and streamlined appearance (see FIG. 2). The tongue 19 is resiliently flexible from the point from which it extends from the base 18.

The top and bottom faces of the base 18 also define a space therebetween to allow room for insertion of a strap or belt 41. The bottom of the base 18 includes a transverse slot 20 (see FIGS. 2 and 5) through which the strap or belt may be fed. The slot 20 defines a crossbar 21 around which the strap or belt is looped.

One or more resiliently flexible legs 22 project from the tongue 19 or the base 18 in a distal direction. Where there are two legs 22, they extend along opposite sides of the tongue 19. Tongue 19 may include one or more guide members 23 for allowing the tongue 19 to fit snuggly within guide chamber 10.

Figure 6:
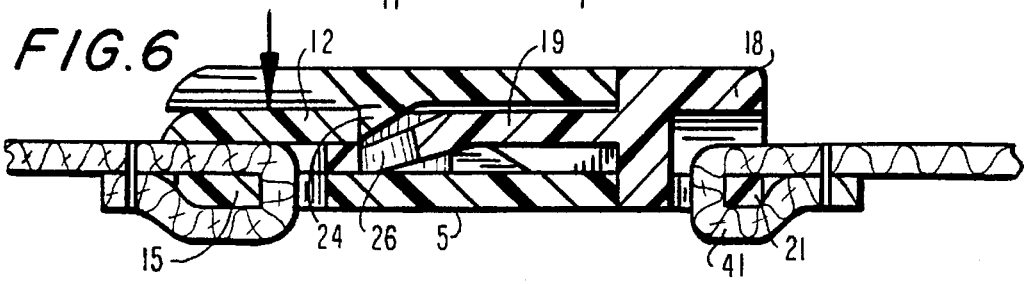
FIG. 6 is the cross-sectional view of FIG. 3 except it shows the flap or hinged member being depressed to disengage the tongue from the lug.

The inner surface of the top face 4 of the socket member 3 includes a locking lug or pin 24 (see FIGS. 3 and 6). The locking lug 24 is not located on the flap 12. Rather, it is located just on the other side of the cutaway line 11 which defines the border of the flap 12. The locking lug 24 has an engaging surface 25 which is preferably canted in a direction so as to form a downhill slope in the direction from the proximal end 8 of the socket toward the insertion end 9 of the socket for reasons which will be discussed below (see FIGS. 3, 5 and 6).

In a region near the distal end of the tongue 19, there is defined a locking aperture or opening 26 which is adapted to snuggly receive the locking lug 24 of the socket member. Preferably, the locking aperture 26 is located near the very distal end of the resilient tongue 19 to allow for greater movement of the aperture, as discussed below.

To couple the two buckle pieces together, the tongue 19 of the plug member 2 is inserted through the opening in the insertion end 9 of the socket 3. When the distal end of the tongue engages the locking lug 24, the canted surface 25 of the locking lug will force the resiliently flexible tongue downward until the locking aperture 26 is aligned with the locking lug 24. In this aligned condition, the locking aperture 26 will be free to slide up over the locking lug 24 and the resilient tongue will be free to move back toward its non-flexed position thereby locking the plug and socket together. In this coupled position, the sloped inner side wall 17 of the socket will cause the arcuate leg 22 of the plug which is adjacent to it to flex inwardly (see FIG. 5).

Figure 7:
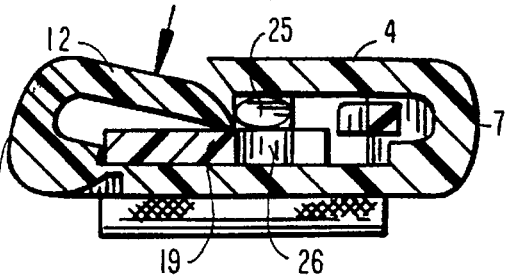
FIG. 7 is the cross-sectional view of FIG. 4 except it shows depression of the hinged member.
Figure 8:
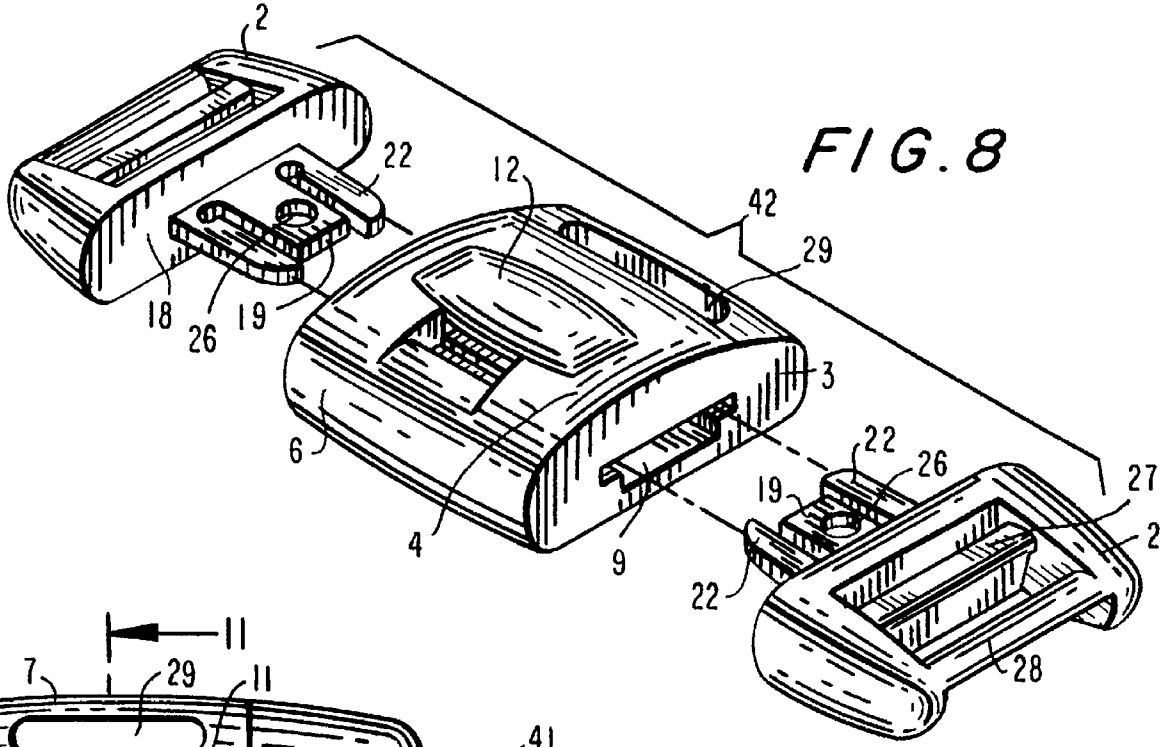
FIG. 8 is a perspective view of a three-piece buckle in accordance with the invention.
Figure 9:
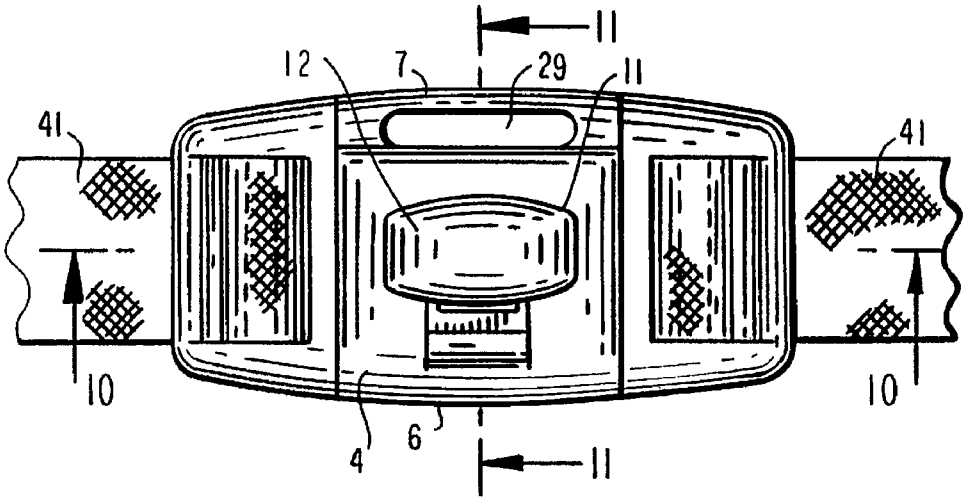
FIG. 9 is a top planar view of the buckle of FIG. 8 wherein the plug members are coupled to the socket member.
Figure 10:
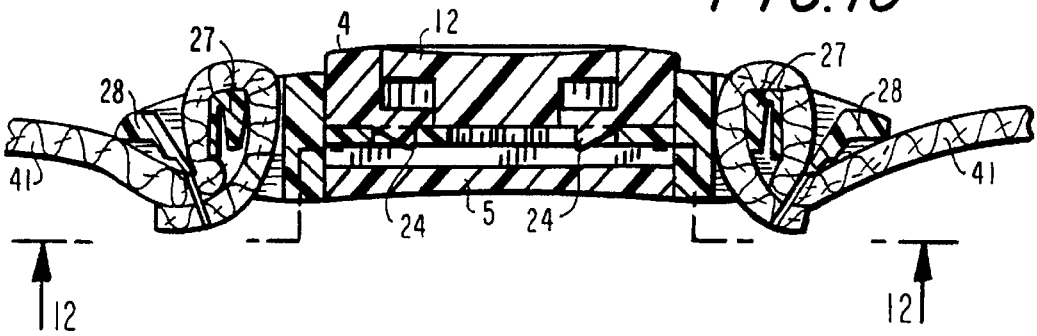
FIG. 10 is a cross-sectional view of the buckle of FIG. 9 taken along line 10—10.
Figure 11:
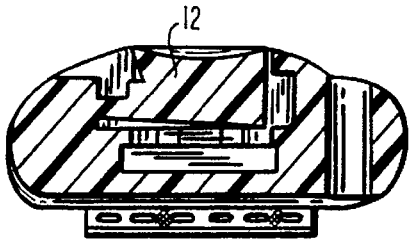
FIG. 11 is a cross-sectional view of the buckle of FIG. 10 taken along the line 11—11.
Figure 12:
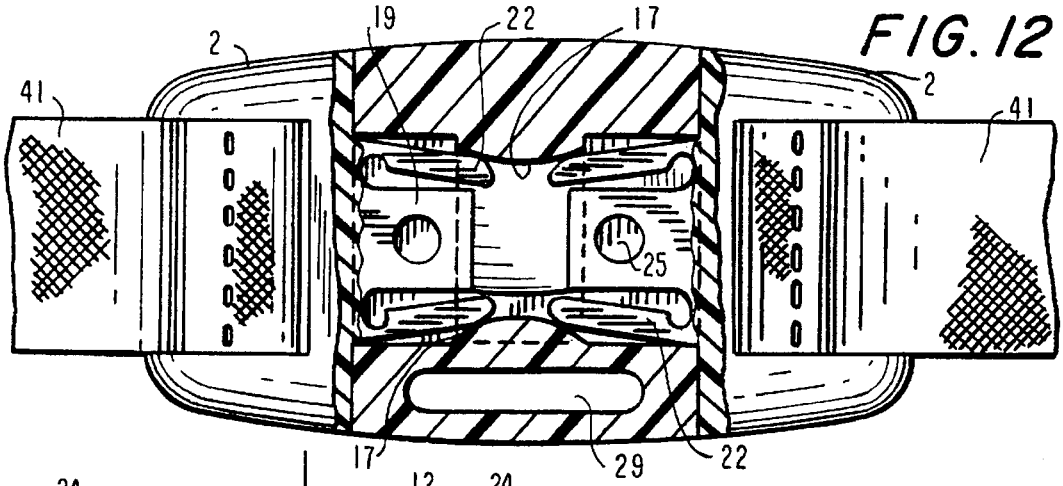
FIG. 12 is a cross-sectional view of the buckle of FIG. 10 taken along the line 12—12.

To release or uncouple the plug member 2 from the socket member 3, one simply presses down on the button or flap 12 to force it into the guide chamber 10 and into contact with tongue 19 (see FIGS. 6 and 7). The movement forces tongue 19 downward and away from locking lug 24 so as to free locking aperture 26 therefrom. As soon as locking aperture 26 is free, the spring force which will be exerted by the now flexed resilient tongue 19 will urge the tongue outward in a direction away from the locking lug 24. This movement is facilitated by the canted surface 25 of the locking lug which is sloped so as to permit the tongue to slide over it. Buckle separation is also greatly facilitated by the spring force exerted by the resilient leg 22 in its flexed position against the sloped side wall 17.

FIGS. 8–14 illustrate a three-piece buckle in accordance with the invention. In the drawings, like reference numerals are used to identify parts or features which correspond to those in the previously described embodiment. This buckle 42 includes a pair of plug members 2 and a single socket member 3. The socket member 3 includes two insertion ends 9 and two locking lugs 24 each having a canted surface 25. The resilient flap or button 12 is once again a cutaway region in the top face 4 of the socket. The locking lugs 24 are located on opposite sides of the flap 12.

The plug members 2 each include a base portion 18 from which a resilient tongue 19 and a pair of legs 22 project distally. Resilient tongue 19 includes a locking aperture 26 defined therein. Each plug has a pair of legs 22 which run parallel to tongue 19 on opposite sides thereof. The base portion 18 of each plug 2 may include a single crossbar as in the embodiment of the invention described above, or a pair of upper and lower crossbars 27, 28, as illustrated for coupling a strap 41. The socket member 3 includes a longitudinally disposed slot 29 for receiving yet another strap or belt (not illustrated).

To assemble the buckle, each plug 2 is inserted into one of the opposite insertion ends 9 of the socket 3, as described above with respect to the two-piece buckle. Each resilient tongue 19 will be flexed downwardly as it slides over canted engaging surface 25 until each locking aperture 26 is aligned with each locking lug 24 whereupon the tongue 19 will be free to return to its original position, thereby locking each aperture 26 on its respective lug 24. In this locked position, the legs 22 of each plug will be flexed inwardly due to the presence of the sloped inner side walls 17 (see FIG. 12).

Figure 13:
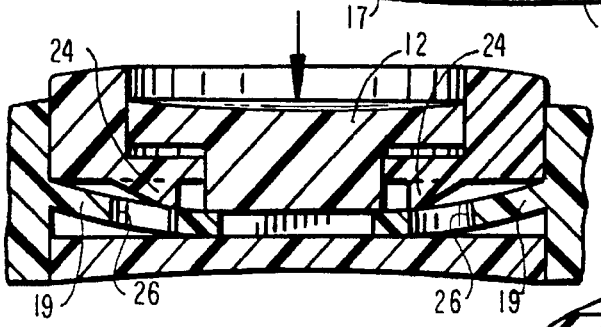
FIG. 13 is the same cross-sectional view illustrated in FIG. 10 except it illustrates the hinged member being depressed to disengage the tongues from the lugs.
Figure 14:
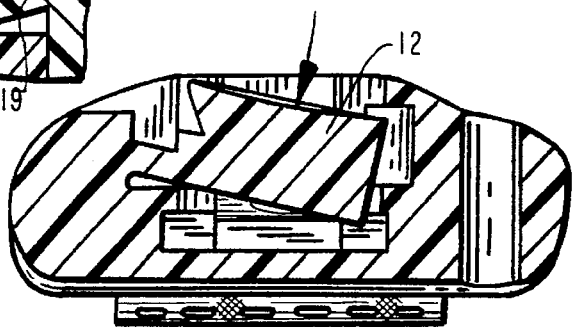
FIG. 14 is the same cross-sectional view as in FIG. 11 except it illustrates the hinged member being depressed.
Figure 15:
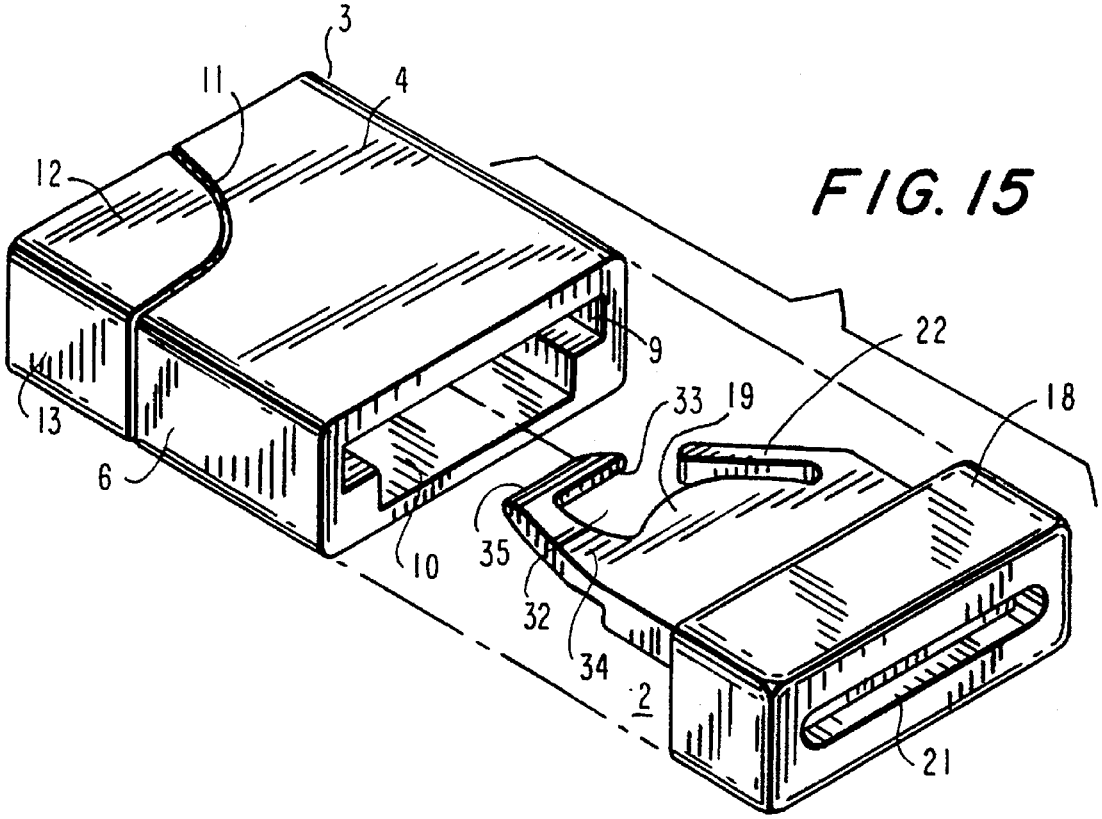
FIG. 15 is a perspective view of a two-piece buckle in accordance with another embodiment of the invention showing the plug member decoupled from the socket member.
Figure 16:
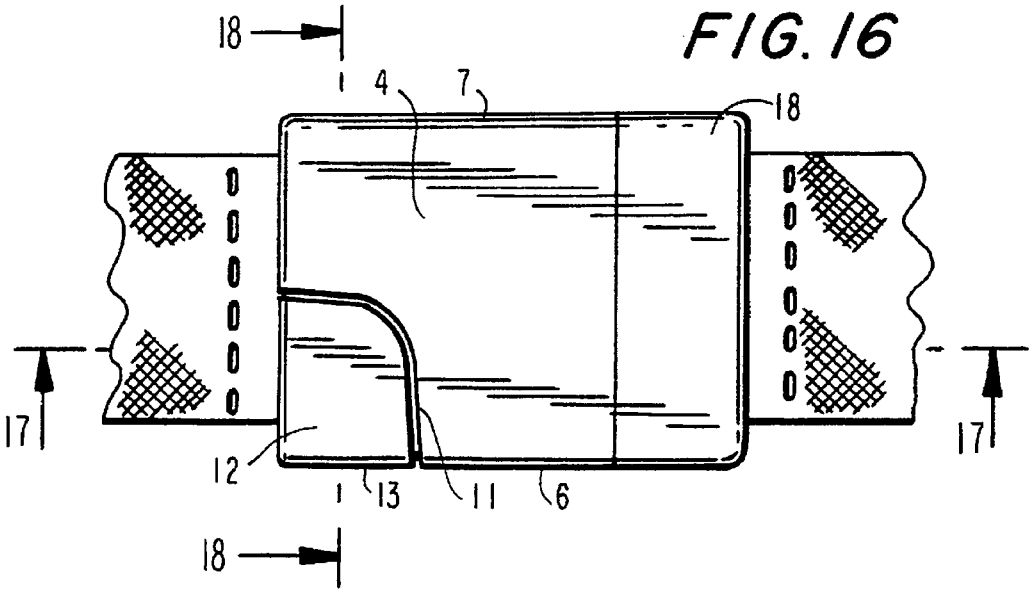
FIG. 16 is a top planar view of the buckle of FIG. 15.
Figure 17:
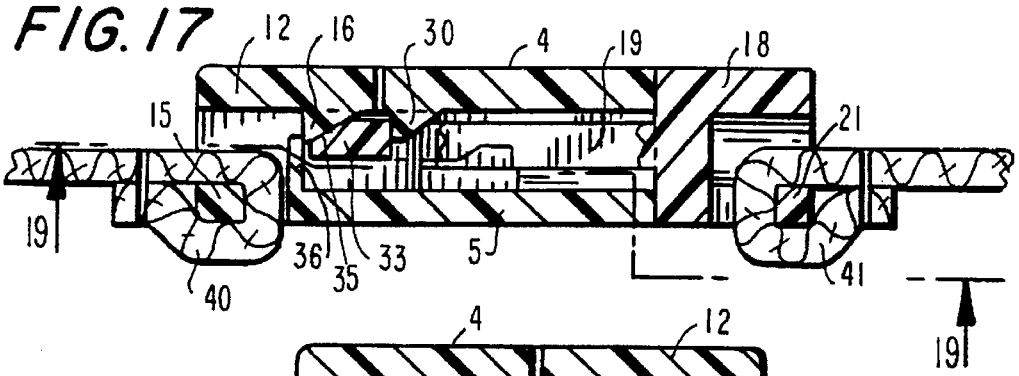
FIG. 17 is a cross-sectional view of the buckle of FIG. 16 taken along the line 17—17.
Figure 18:
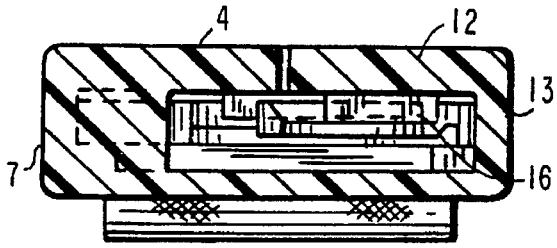
FIG. 18 is a cross-sectional view of the buckle illustrated in FIG. 16 taken along the line 18—18.
Figure 19:
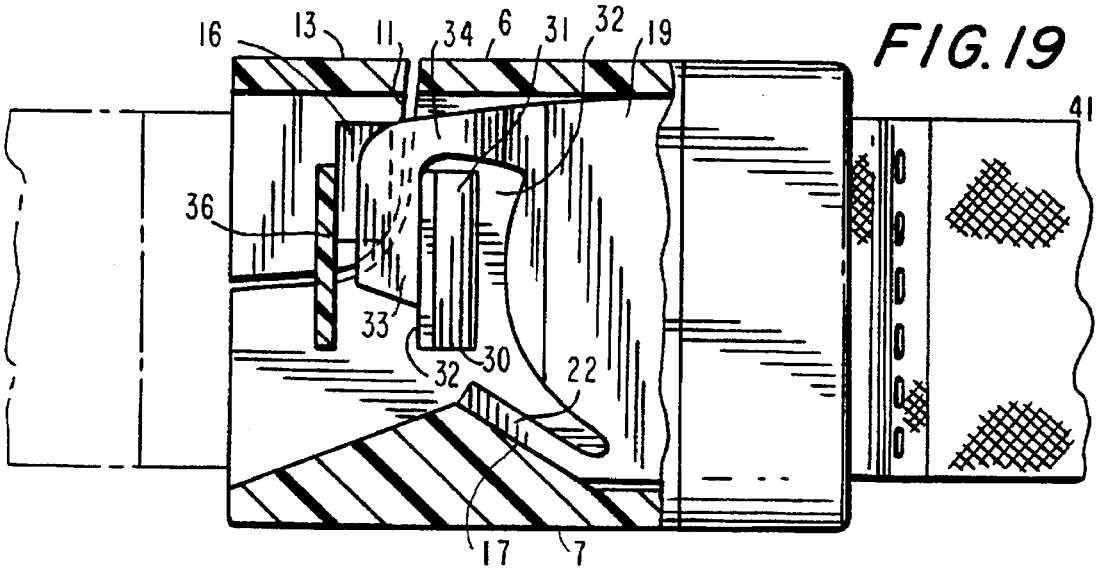
FIG. 19 is a cross-sectional view of the buckle of FIG. 17 taken along the line 19—19.
Figure 20:
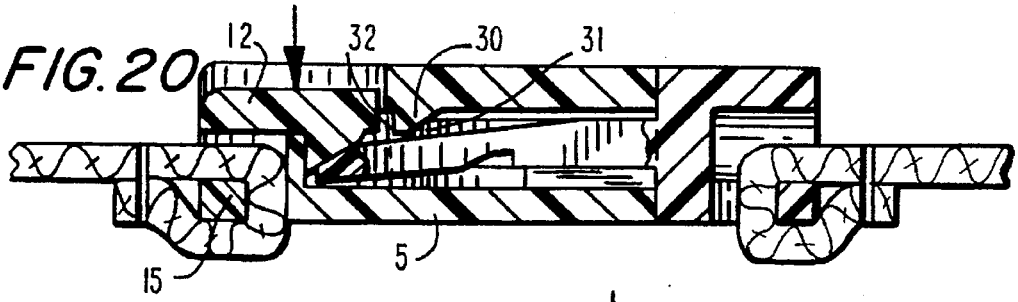
FIG. 20 is the same cross-sectional view as in FIG. 17 except the hinged member is depressed thereby disengaging the latch from the stopper bar.
Figure 21:
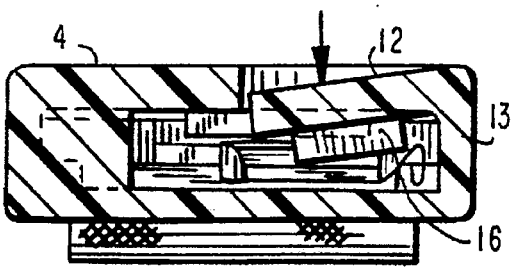
FIG. 21 is the same cross-sectional view as in FIG. 18 except the hinged member is depressed to disengage the latch from the stopper bar.

To release or uncouple each plug member 2 from the socket, the button 12 is depressed which causes it to move each resilient tongue 19 downward and away from each locking lug 24 until each locking aperture 26 clears each lug (see FIGS. 13 and 14). The forces exerted by the resilient tongues 19, as well as those exerted by legs 22 now urge each plug outward from the socket to open the buckle.

Another embodiment of the invention is illustrated in FIGS. 15–21. In the drawings, like reference numerals are used to identify parts which correspond to those in the previously described embodiments. In this embodiment, the locking lug belonging to the socket member 3 is replaced by a transverse stopper bar 30 having a canted surface 31, and a second surface 32 which is normal to the inner surface of the top face 5. Transverse is used to denote the direction between side 6 and side 7, namely, transverse to the insertion direction of the plug member. The locking aperture in the tongue 19 of the plug member 2 is replaced by a locking opening 32 which is defined by a transverse latch 33 held at the end of an arm 34 projecting from tongue 19. The inside surface of the flap 12 has a releasing member or projection 16 which extends into the guide chamber 10.

To couple the plug member 2 to the socket member 3, the latch 33, arm 34 and tongue 19 of the plug member are inserted into the insertion opening 9 in the socket until latch 33 is forced over stopper bar 30. As the latch 33 is forced over the stopper bar, the resilient arm 34 flexes downward until the latch clears the stopper bar whereupon the arm snaps back to its original position and the latch 33 is locked behind the stopper bar 30. In this position, leg 22 is flexed inward slightly against sloped side wall 17 (see FIG. 19).

To release the buckle, the resilient flap 12 is pushed downward whereupon the releasing lug 16 acts on the latch 33 to force it downward until it clears stopper bar 30 (see FIGS. 17–21). At this point, the force exerted by the resilient arm 34 and the leg 22 urges the plug member 2 outward and the buckle is released. The upper surface 35 of latch 33 is preferably canted (see FIG. 15) in the same manner as surface 31 of stopper bar 30 to facilitate sliding of surface 35 of latch 33 over surface 31 of stopper bar 30. The bottom wall 5 of the socket member 3 may include an upwardly projecting guide bar 36 positioned behind the releasing lug 16. The guide bar 36 may also be canted so that it functions to direct the latch 33 outward as the latch 33 is forced downward over it to further facilitate releasability.

In all embodiments, it will be appreciated that arranging the flap 12 to hinge along a line 13 along one of the sides 6, 7 of the socket member 3 of the buckle, leaves a greater amount of space in the socket member to allow room for, for example, the sloped side wall 17 and a leg 22 which cooperate as described above to improve buckle releasability. In addition, locating the flap 12 along a side of the buckle, rather than in the center of the socket member as in some of the prior art, makes the buckle more easily releasable using a person's thumb. Finally, the use of a locking opening or aperture on the tongue of the plug member for engaging a bar or lug in the socket member provides overall better lockability and operation than the use of a lug on the plug member as in the prior art.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A buckle comprising:

a socket member having an obverse face and a pair of sides, wherein the obverse face and the sides define a socket therebetween, the socket member having a first open end and a second open end which is opposite the first open end;

a flap belonging to the socket member, the flap being resiliently flexible and pivotable about a point of attachment of the flap to the socket member, and the flap being depressible to a location in which the flap projects inside the socket;

a first stopping member and a second stopping member each projecting from an inner surface of the socket member toward the interior of the socket;

a first plug member having a base portion and a resilient tongue projecting from the base portion, the tongue having a stopping member thereon; and a second plug member having a base portion and a resilient tongue projecting from the base portion, the tongue having a stopping member thereon;

wherein the socket member is adapted to slidably receive the tongues through the open ends of the socket member, so as to couple the socket member and the plug members, and wherein the first and second stopping members of the socket engage the stopping members of the first and second plug members, respectively, to lock the plug members to the socket member when the plug members are coupled to the socket member, and wherein the plug members may be unlocked from the socket member by depressing the flap toward the interior of the socket to simultaneously force the resilient tongues away from the first and second stopping members and disengage the stopping members of the resilient tongues from the first and second stopping members of the socket thereby permitting decoupling of the plug members and the socket member.

2. The buckle according to claim 1 wherein the first plug member and the second plug member each include at least one flexible leg projecting from the base portion alongside the resilient tongue, and wherein the sides of the socket member include inner surfaces which engage the leg of each plug member when each plug member is locked into the socket member causing the legs to flex.

3. The buckle according to claim 1 wherein the first plug member and the second plug member each include a pair of flexible legs projecting from the base portion disposed on opposite sides of the resilient tongue, and wherein the sides of the socket member include inner surfaces which engage the legs of each plug member when each plug member is locked into the socket member causing the legs to flex.

4. The buckle according to claim 3 wherein the legs of each plug member are parallel to one another.

5. The buckle according to claim 1 wherein each of the first and second stopping members of the socket has a surface which is canted in a direct to permit sliding movement of the tongues over the canted surfaces when the tongue are inserted into the socket.

6. The buckle according to claim 5 wherein the stopping members of the first and second plug members each have a canted upper surface which is adapted to slide along the slanted surface of the first and second stopping members of the socket, respectively, to facilitate decoupling of the plug members from the socket member.

7. The buckle according to claim 1 further comprising a releasing lug projecting toward the interior of the socket from an inner surface of the flap for engaging at least one of the tongues upon depression of the flap.

8. The buckle according to claim 1 wherein the stopping members of the first and second plug members are each an aperture defined in the tongue to which the stopping member belongs.

* * * * *

UNITED STATES PATENT AND TRADEMARK OFFICE

CERTIFICATE OF CORRECTION

PATENT NO. : 5,659,931
DATED : August 26, 1997
INVENTOR(S) : Joseph Anscher

It is certified that error appears in the above-identified patent and that said Letters Patent is hereby corrected as shown below:

Column 8, line 28, change "slanted" to --canted--.

Signed and Sealed this

Twenty-second Day of September, 1998

*Attest:*

Bruce Lehman

BRUCE LEHMAN

*Attesting Officer*

*Commissioner of Patents and Trademarks*